US005782952A

United States Patent [19]

Diaz et al.

[11] Patent Number: 5,782,952

[45] Date of Patent: Jul. 21, 1998

[54] METHOD FOR PRODUCTION OF MAGNESIUM

[75] Inventors: Alexander F. Diaz, Cambridge; Jack B. Howard, Winchester; Anthony J. Modestino, Hanson; William A. Peters, Lexington, all of Mass.

[73] Assignee: Massachusetts Institute of Technology, Cambridge, Mass.

[21] Appl. No.: 706,076

[22] Filed: Aug. 30, 1996

[51] Int. Cl.[6] ..... C22B 26/22

[52] U.S. Cl. ..... 75/10.19; 75/10.33; 75/596; 75/599; 373/18

[58] Field of Search ..... 75/596, 599, 10.19, 75/10.2, 10.21, 10.33; 373/18

[56] References Cited

U.S. PATENT DOCUMENTS

| | | | |
|---|---|---|---|
| 2,364,742 | 12/1944 | Merriam | 75/67 |
| 2,398,443 | 4/1946 | Munday | 75/26 |
| 2,582,120 | 1/1952 | Hansgirg | 75/67 |
| 3,427,152 | 2/1969 | Eisenberg et al. | 75/67 |
| 3,441,402 | 4/1969 | Magee et al. | 75/10 |
| 3,783,167 | 1/1974 | Tyiko | 75/10.22 |
| 4,147,534 | 4/1979 | Hori | 75/67 R |
| 4,290,804 | 9/1981 | Avery | 75/67 |
| 4,583,229 | 4/1986 | Yu | 373/18 |
| 4,699,653 | 10/1987 | Barcza et al. | 75/10.19 |
| 4,801,435 | 1/1989 | Tyiko | 75/10.19 |

OTHER PUBLICATIONS

U.S. Bureau of Mines, Rpt. of Investigations 6949, An Ecomonmic and Technical Evaluation of Magnesium Production (in three parts), 1967, Part 2, Carbothermic, pp. 7–9, Month Unavailable.

Int. J. Hydrogen Energy, vol. 20, No. 10, pp. 793–804, 1995, No. Month.

Energy, vol. 20, No. 7, pp. 695–704, 1995, No. Month.

Energy, vol. 20, No. 9, pp. 857–868, 1995, No. Month.

Solar Engineering, vol. 1, pp. 375–380, ASME 1995, No Month.

Joint Solar Engineering Conference, ASME, pp. 59–66, 1994, No. Month.

Energy, vol. 17, No. 2, pp. 179–190, 1992, No. Month.

Energy, vol. 16, No. 7, pp. 1011–1019, 1991, No Month.

*Primary Examiner*—Melvyn Andrews

*Attorney, Agent, or Firm*—George W. Neuner

[57] ABSTRACT

A continuous process for the production of elemental magnesium is described. Magnesium is made from magnesium oxide and a light hydrocarbon gas. In the process, a feed stream of the magnesium oxide and gas is continuously fed into a reaction zone. There the magnesium oxide and gas are reacted at a temperature of about 1400° C. or greater in the reaction zone to provide a continuous product stream of reaction products, which include elemental magnesium. The product stream is continuously quenched after leaving the reaction zone, and the elemental magnesium is separated from other reaction products.

22 Claims, 8 Drawing Sheets

METHOD FOR PRODUCTION OF MAGNESIUM

This invention was made with government support under contract Number DE-AC22-92PC92111 awarded by the U.S. Department of Energy. The government has certain rights in the invention.

FIELD OF THE INVENTION

The present invention relates to methods for producing magnesium metal, i.e., elemental magnesium, from magnesium oxide and, more particularly, to a continuous process for the production of magnesium from magnesium oxide and methane.

BACKGROUND OF THE INVENTION

Magnesium has generally been produced by one of two basic methods: electrolysis of molten magnesium chloride to molten magnesium metal and chlorine gas or thermal reduction of magnesium oxide with ferrosilicon or solid carbon. Some drawbacks of the electrolytic method are the extensive effort required to prepare material for the cell feed and the low metal production rates. Also, the electrolytic and ferrosilicon processes both exhibit high energy demands.

Magnesium can be reduced by solid carbon at temperatures of 2000° C. and above. The reduction is highly endothermic and proceeds only with a continuous input of heat energy such as, for example, by an electric arc. Even at temperatures below about 2000° C. magnesium vapor will reoxidize in an atmosphere containing carbon monoxide. To minimize this reoxidation, methods for production of magnesium generally involve sudden cooling of the vapor and gases. In the so-called Hansgirg process, the cooling is accomplished by using large volumes of hydrogen or natural gas.

U.S. Pat. No. 2,364,742 describes a cyclic process for reducing solid magnesium oxide with methane. It states that, at high temperatures, the methane will thermally decompose into hydrogen and carbon, which are relatively ineffective for reducing the solid magnesium oxide. Consequently, it is taught to apply the methane gas to the heated solid in an abrupt manner to prevent decomposition of the methane prior to the reaction. More specifically, the solid magnesium oxide is admixed with a solid carbonaceous material, such as coke, and the mixture is introduced into the reactor. A blast of intensely preheated air is passed through the admixture until sufficient coke is burned to raise the temperature of the admixture above the reduction temperature of magnesium oxide. The air blast is discontinued and methane or natural gas is introduced into the admixture as a blast. The magnesium vapor is then condensed and separated from the gases. The process is thus an intermittent or cyclic process for the reduction of magnesium oxide.

In a report of investigations 6046 to the U.S. Bureau of Mines, "An economic and technical evaluation of magnesium production methods (in three parts). 2. Carbothermic" by Elkins, D. A. et al., a carbothermic process used in the Permanente magnesium plant was described. In the process, magnesia and coke were ground, briquetted and fed into an arc reduction furnace under hydrogen. Magnesium vapor and carbon monoxide were quenched in natural gas on leaving the furnace.

U.S. Pat. No. 4,290,804 describes a process in which magnesium is recovered from superheated gases essentially consisting of carbon monoxide and magnesium vapor by shock cooling the vaporous composition with a spray of liquid magnesium preferably heated to a temperature near its vaporization temperature. The liquid magnesium is instantly vaporized with a large absorption of energy and the vaporous mixture is thereby cooled to a temperature somewhat above the vaporization temperature of magnesium. The resultant vaporous magnesium is recovered by condensation to produce a molten magnesium product.

There is a need for more efficient and more economical processes for making magnesium metal such as processes that operate continuously at atmospheric pressure with inexpensive feed materials.

SUMMARY OF THE INVENTION

The present invention provides a continuous process for producing magnesium metal from magnesium oxide and methane. The method of the present invention comprises mixing magnesium oxide and a light hydrocarbon gas to form a feed stream, continuously supplying the feed stream to a reaction zone, reacting the magnesium oxide and gas at a temperature of about 1400° C. or greater to provide a product stream of reaction products that includes unconverted feed materials and the desired elemental magnesium product, quenching the product stream containing reaction products, and separating the elemental magnesium for recovery.

The magnesium oxide (MgO) used in the process can be magnesium oxide, a magnesium oxide mineral (e.g. calcined dolomite $\{(CaO)_x(MgO)_y\}$) or a magnesium oxide precursor such as for example, dolomite $\{(CaCO_3)_2(MgCO_3)_6\}$, magnesium carbonate and magnesium hydroxide, and mixtures of any of these materials. When magnesium oxide precursors are used, preferably the precursor materials are calcined before mixing with the light hydrocarbon gas.

Light hydrocarbon gases are $C_1$–$C_3$ gases, i.e. methane, ethane, propane, or mixtures thereof. Preferably, methane or natural gas is used in the process of this invention. For the case of methane, the reaction can be represented as follows:

$$MgO+CH_4 \rightarrow Mg+CO+2H_2 \quad (1)$$

The Mg metal is separated and then recovered from other products by suitable techniques, e.g., condensation on a low temperature surface, contacting with a bath, stream or spray of cooler fluid such as molten magnesium, followed as needed by purification by remelting, distillation, flushing with magnesium in suitable form, etc.

Preferably, the reaction is carried out in a flow reactor where the gas stream is preheated, e.g., by exchange with the reaction product stream. The reaction temperature can be supplied in the reactor by using, as a source of energy, combustion of a suitable fuel, in air, or $0_2$-enriched air, or $O_2$, with or without preheat of the oxidant (e.g. air) and/or by electrical heating including use of an electrical arc discharge such as a thermal plasma. Examples of suitable fuels include natural gas, methane, $H_2$ or CO. Both $H_2$ and CO could be obtained from the products of the reaction illustrated by equation (1) after separation of the Mg. Electricity for heating and other process applications can be generated by any convenient method, e.g., combustion of $CH_4$ or other appropriate fuels in gas turbines with or without combined cycles. Alternatively, the hydrogen by-product can also be used to generate electricity using fuel cells.

DETAILED DESCRIPTION OF THE INVENTION AND PREFERRED EMBODIMENTS

Figure 1:
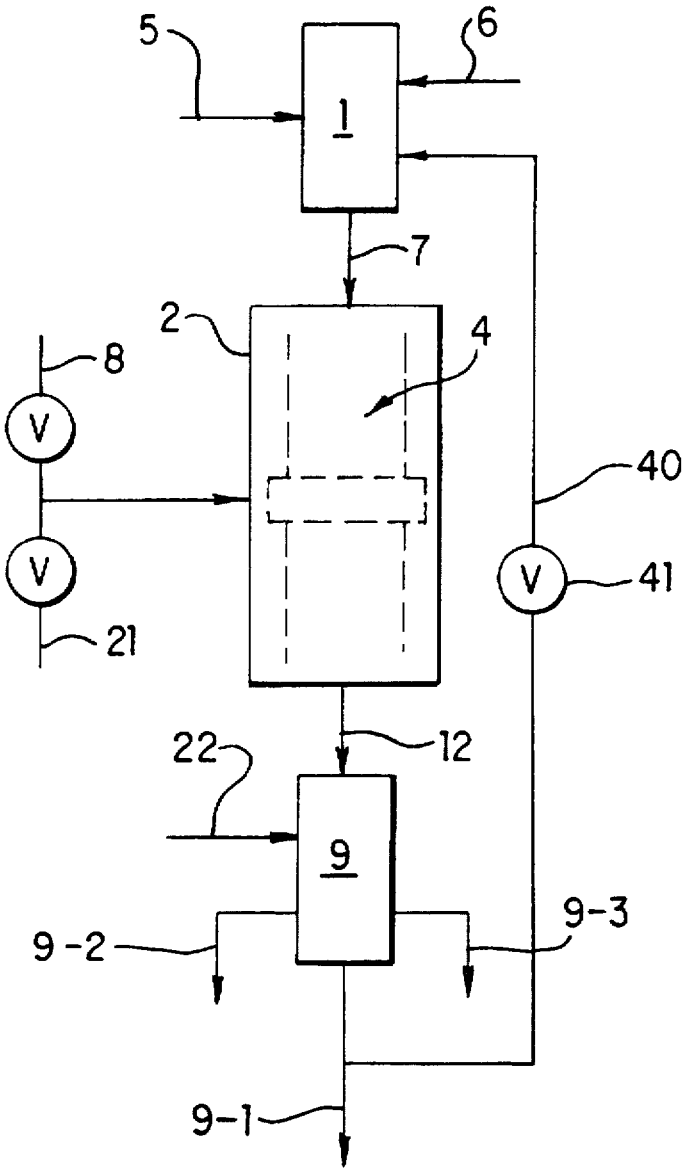
FIG. 1 is a schematic diagram illustrating one embodiment of the process of the present invention.

In accord with the present invention, a continuous process prepares elemental magnesium from (i) magnesium oxide (MgO) or a magnesium oxide precursor material and (ii) methane, or natural gas, or other light hydrocarbon gas or gas mixtures. With reference to FIGS. 1, 2, 3 and 4, embodiments of the process will be described in detail with reference to the preferred embodiments. MgO 5 and natural gas 6 are fed into and mixed in a premixing chamber 1 (FIG. 1) at temperatures low enough that significant reaction of the starting materials in the feed stream does not occur in this chamber. Typically, temperatures of about 650° C. or less are used.

The mixture of MgO and natural gas, as the feed stream 7 is then supplied to a main reaction chamber 4, which is enclosed or encased in a suitable enclosure vessel 2. Chamber 4 can be considered as having certain regions (see FIG. 2). Within an upper portion of region 14 in chamber 4, the mixture is rapidly heated to a temperature sufficiently high that elemental magnesium (Mg), and one or more valuable gaseous co-products, such as carbon monoxide (CO) and molecular hydrogen ($H_2$), form in appreciable yields. A temperature of at least about 1400° C. is required. Preferably, temperatures of at least about 1800° C. are used; and in some embodiments, temperatures can be about 2000° C. or more. For example, when the feed gas consists of natural gas which is largely methane ($CH_4$), the chemical reaction (1) describes the overall chemistry of elemental magnesium production by the process. Products and unconverted feed are partially cooled in a lower portion of region 14 and then transferred by line 12 to a products separation chamber 9 (FIG. 1), which separates elemental magnesium from the product stream. The magnesium can be sent for storage, further purification, or utilization in a particular process.

Preferably, the MgO is prepared for the premixing chamber 1, e.g. by grinding, so that at least 85 wt % of it is in the form of small particles. Preferably, the particles have an average size of about 2–3 mm. or less, more preferably about 1 mm. or less. Typically, less then 15 wt % of the particles are greater than about 1 cm in average size; preferably less than 5 wt % are greater than about 1 cm in average size. In some embodiments, depending upon the particular equipment used, it may be preferred to use MgO of an even smaller particle size distribution, e.g., 85 wt % of the particles having an average size of about 0.2 mm. or less. As used herein, the term "average size" means the particle size diameter or equivalent diameter of the particle.

The premixing chamber 1 can be a dense phase fluidized bed, (e.g. see chamber 24, FIG. 3), a transfer line, an entrainment tube, or other suitable gas-solids mixing apparatus, which are well known to those skilled in the art.

When an MgO precursor, e.g. magnesium carbonate ($MgCO_3$) magnesium hydroxide ($Mg(OH)_2$), etc., or the like is the source of MgO, the MgO is first prepared from that source, e.g., by calcining under conditions that are well known in the art. Thus, in the case of magnesium carbonate or magnesium hydroxide, for example, the following reactions would be carried out generally in a vessel separate from the premixing chamber 1:

$$MgCO_3 \rightarrow MgO + CO_2 \quad (2)$$

$$Mg(OH)_2 \rightarrow MgO + H_2O \quad (3)$$

The solid MgO is separated from the $CO_2$ and $H_2O$ by any suitable means well known to those skilled in the art, e.g., scrubbing out the $CO_2$, condensation of the $H_2O$, use of cyclone(s), etc. The solid MgO is then introduced into the premixer 1.

Various other minerals may be attractive sources of magnesium and useful for making a solids feed stream for the present invention. Two minerals that are particularly attractive are dolomite—$(CaCO_3)_a(MgCO_3)_b$—and calcined dolomite—$(CaO)_x(MgO)_y$. Calcined dolomite can be used in the invention according to essentially the same procedures described herein for use of MgO. However, the CaO in the calcined dolomite will be converted, at least partially, to the valuable product calcium carbide ($CaC_2$). Calcium carbide is of significant commercial value because it can be converted to acetylene ($C_2H_2$) in high yields by reaction with water, i.e.:

$$CaC_2 + 2H_2O \rightarrow Ca(OH)_2 + C_2H_2 \quad (4)$$

The premixer 1 is typically operated at a temperature low enough to prevent appreciable unwanted chemical reactions of the feed materials, generally less than 650° C., preferably at a temperature of 250° C. or less, and more preferably 125° C. or less. The feed mixture 7 is conveyed from the premixer 1 to a main reactor chamber 4 where this mixture is heated, preferably quite rapidly, to a temperature sufficiently high to cause conversion of the MgO to Mg, in the chamber 4. This temperature should be at least 1400° C., preferably at least 1800° C., and can be much higher (2000° C. or more), particularly if certain means of feed heating, such as a thermal plasma, are employed.

Typically, the conversion of MgO to Mg in the reaction chamber 4 by the process of the present invention is at least about thirty percent of the magnesium entering the process as MgO, and preferably about fifty to sixty percent. The converted magnesium can be recovered from the process effluent stream 12 as elemental magnesium. Typical residence times of the reactants, i.e., MgO and gas, in the reaction chamber 4 at these elevated temperatures are at least about 0.01 seconds. Generally, the residence time at elevated temperatures of 1400° C. or more is not greater than about several seconds. Preferably, the residence time is about a few tenths of a second. However, the preferred residence time will depend on the specific conditions and the feed materials used in the reaction, including the particular method used to achieve rapid heating of the feed stream 7.

The pressures in the premixer 1, the main reactor chamber 4, the effluent and transfer line 12, and the magnesium separation chamber 9, are typically maintained above the prevailing atmospheric pressure to prevent leakage of atmospheric air into the process equipment. The pressures can be different in these four regions and generally will be at least a few inches of water above the atmospheric pressure. For certain embodiments, the pressure can be as high as several tens of atmospheres for the most efficient operation of the equipment.

After reaction has occurred in the upper region of chamber 14, the products and unreacted feed are cooled, preferably rapidly, to reduce or prevent loss of elemental magnesium, e.g., by reaction with carbon monoxide according to the reaction:

$$CO+Mg \rightarrow C+MgO \quad (5)$$

Preferably, the loss of magnesium by reoxidation is small or insignificant. The cooling is also implemented in a manner that will help present the converted magnesium in a form that facilitates subsequent recovery, storage or purification. Thus, in one preferred embodiment of the invention, the magnesium is recovered from the separator chamber 9 primarily as liquid magnesium and, therefore, the temperature to which the effluent gas and reaction products are cooled is no lower than 650° C., and preferably no lower than 700° C. In another preferred embodiment of the invention, the magnesium is recovered from separator 9, appreciably or primarily, as solid matter, e.g., as solid magnesium or as a solid material from which it can be readily recovered as elemental magnesium. In this case, the temperature to which the reaction products are cooled down is 645° C. or less, and preferably 600° C. or less. In still a third preferred embodiment, the Mg is separated from solid products or unconverted solid reagents, substantially or primarily as vapor. In this case, the temperature to which products are cooled is no lower than about 1100° C.

The cooling of the reaction products and unconverted feed can be accomplished by any of a number of means well known to those skilled in the art. Such means of cooling include, for example: (i) extraction of heat from the immediate environs of the products, i.e., from a suitable portion of the region 14, by transfer of heat through the walls of the reaction chamber 4; or (ii) introduction of appropriate "quenching agents" 8 (to which reference may be made herein as "Q") or "quenching/recovery agents" 21 (to which reference may be made herein as "Q-R"), or both Q and Q-R. In the case of using quenching agents 8, heat is extracted from the reaction products by transfer of the heat to the quenching agent by physical means, or by virtue of a phase change or by endothermic chemical reaction involving one or more ingredients in the quenching agent 8, or by any combination of these means. The quenching/recovery agents 21 also can extract heat from the reaction products by any of the means noted. However, the quenching/recovery agents 21 also serve to help redeploy the magnesium to a form more suited to separation, storage, or recovery, e.g., by operations carried out in separation chamber 9, or to a form more suited for purification or a specific utilization.

The quenching agents 8 or quenching/recovery agents 21 can be introduced to the stream of reaction products and unconverted feed at a location within the main reactor chamber 4, i.e., in the region 14 by means of an injector plenum 13, which is already positioned in or, as desired, which can be brought into communication with the appropriate section of region 14. The injector plenum can be fixed or movable so that the Q or Q-R agents can be fed into various sections of region 14, as desired. The location(s) for injection of the Q or Q-R agents are selected to help achieve high levels of production of elemental magnesium, e.g., according to reaction (1), without undue reoxidation of Mg and, further, to avoid or reduce to acceptable levels, the generation of undesired by-products such as, e.g., coke or other carbonaceous solids.

Examples of quenching—Q—agents suitable for the practice of the present invention include non-reactive solid particles (e.g., refractory ceramic particles), liquid droplets (e.g., liquid magnesium), vapors and gases, or mixtures thereof. Properties of the solid particles that can be selected to enhance separation of the product are particle size distribution, shape (e.g., spherical or rod-like, etc.), internal surface area, total surface area, pore size distribution, surface texture, morphology, and the like, etc. Liquid droplets can also be varied in size distribution to enhance product collection. Further, such agents can be capable of undergoing endothermic changes of state by physical or chemical means (e.g., melting, evaporating, subliming, change of crystal form, etc.) at temperatures suitable for quenching elemental magnesium or other desired products of the process.

Examples of quenching/recovery—Q-R—agents suitable for the practice of the present invention also include solid particles, liquid droplets, gases, vapors, and mixtures thereof, from which elemental magnesium can be readily separated. Q-R agents are typically selected because they exhibit one or more of the chemical or physical attributes listed above with respect to Q agents. However, it will be recognized by those skilled in the art that specific properties can receive greater or lesser emphasis for Q-R agents than they do for Q agents. However, although Q and Q-R agents can be similar materials, Q-R agents are selected to enhance recovery and can bind or carry the magnesium in a manner such that the magnesium is readily extracted as elemental magnesium. As such, Q-R agents can increase product recovery, product purity, etc.

Products and converted feed exit the main reactor chamber 4 by means of a transfer line 12 and enter a products separation chamber 9. The transfer line 12 can penetrate the chamber 4 to different depths and can be positioned in any convenient location within the chamber 4. The transfer line can also be used to cool reaction products as a substitute for, or in addition to, the products cooling by means of the injection plenum 13.

FIG. 1 shows the products separation chamber 9 as physically separate from the main reactor chamber 4. However, it can be recognized by those skilled in the art that the separation chamber 9 can also be located within the main reactor chamber.

In separator 9, elemental magnesium in solid form, liquid form, vapor form, or as mixtures of two or three of these phases, is separated from other products and unreacted feed of this process. Depending on the phase of the Mg, a series of separations can be employed, e.g., first keeping the Mg as vapor while various solids are removed (at 9-1), and then removing Mg from the vapor phase in order to separate if from gaseous products like CO and $H_2$ (at 9-2), and from unconverted feed materials such as methane ($CH_4$), which can be recycled through line 40 to the premixing chamber 1.

Separation methodologies can include any techniques common in the separation of gases and vapors from solids, e.g., cyclones, centripeters, staged cascade impactors, etc. However, as noted above, magnesium recovery agents can be utilized to capture and retain elemental magnesium. These recovery agents can already be present in the chamber 9, can flow into the chamber 9 via the feed line 22, or can be introduced into the reaction products at higher temperature by means of the injection plenum 13. These agents can be gases, vapors, liquids, or solids of particular chemical composition and, in the case of liquids, having a selected droplet size distribution, and in the case of solids, having a selected particle size distribution, total surface area, internal surface area, shape, pore size distribution, surface texture and morphology, as desired for particular equipment and operating conditions. Any or all of these methods and agents can be used to capture and retain magnesium in the separator chamber 9 for a desired time and in forms that facilitate recovery of the magnesium for storage, further purification, or specific applications.

Those skilled in the art will recognize that a variety of physiochemical phenomena can contribute or be utilized to bring about magnesium separation or recovery within chamber 9, e.g., condensation or partitioning of magnesium vapor as liquid or solid, solidification of liquid magnesium as solid, physisorption, chemisorption, or other means of partitioning vapor, liquid, solid, or mixed phase magnesium onto or within a surface or host substrate exhibiting suitable affinity for magnesium by virtue of its temperature, composition, structure etc. Dissolution of magnesium in a liquid or induction of magnesium into a bath of materials, some of which can be molten, etc., are alternative means of collection. Elemental magnesium can then be recovered from chamber 9 in a suitable form by tapping (if desired, preceded by float sink separation from solids), remelting, distillation, thermal treatment, flushing, etc., or a combination of methods as needed.

Preferably, the feed stream 7 is rapidly heated to a desired temperature. Rapid heating of the feed stream can be accomplished by a variety of methods well known to those skilled in the art. In a preferred embodiment of the invention, an electrical arc discharge is struck between a cathode 50 (negative) and an anode 51 (positive) of a device 3 that can be structured and arranged as illustrated schematically in FIG. 4. The feed stream flows between the electrodes and cooling fluids can be circulated in the anode. A magnetic field, provided by means such as a solenoid (not shown in FIG. 4), can be used to stabilize or otherwise manipulate the arc discharge.

The feed stream 7 is directed into the reaction chamber 4 and preferably through an electrical arc discharge wherein it is heated to elevated temperatures and, using methane as an example of the feed gas, elemental magnesium is generated according to the overall chemical reaction (1).

Another preferred method of heating the feed stream 7 within some portion of the region 14 within chamber 4 is by transmission of heat, e.g., by radiation, convection, or conduction, from the external walls of the chamber to heat the feed stream. The walls can be heated, e.g., by electrical heaters or by heat exchange with a hot fluid within the flue region 19 between chamber 4 and the inside wall of the enclosure vessel 2, or by thermal radiation from the inside surface of the walls of enclosure vessel 2 (in analogy to heating in a muffle furnace). In one embodiment, high temperature flue gas to heat the external walls of the main reactor chamber 4 can be supplied by combustion of a suitable fuel in air, in $O_2$, with or without preheating the oxidant (e.g., air), by electrical heating, and by direct or indirect heating with an electrical arc discharge.

Suitable fuels include natural gas, methane, $H_2$, CO (with $O_2$), $H_2$/CO mixtures of suitable composition, etc. For example, the $H_2$ or CO or both, can be obtained from the effluent by-products of Reaction (1), after separation of the Mg. Electricity for heating, for operating an electric arc discharge, and for other process requirements can be generated by any convenient method, e.g., from electrical generators powered by combustion of natural gas or other appropriate fuel in gas turbines, from combined gas turbine, steam turbine electric power cycles, etc. Alternatively, electricity can be generated using fuel cells, e.g., fueled with $H_2$, including the $H_2$ by-product of this process.

Figure 2:
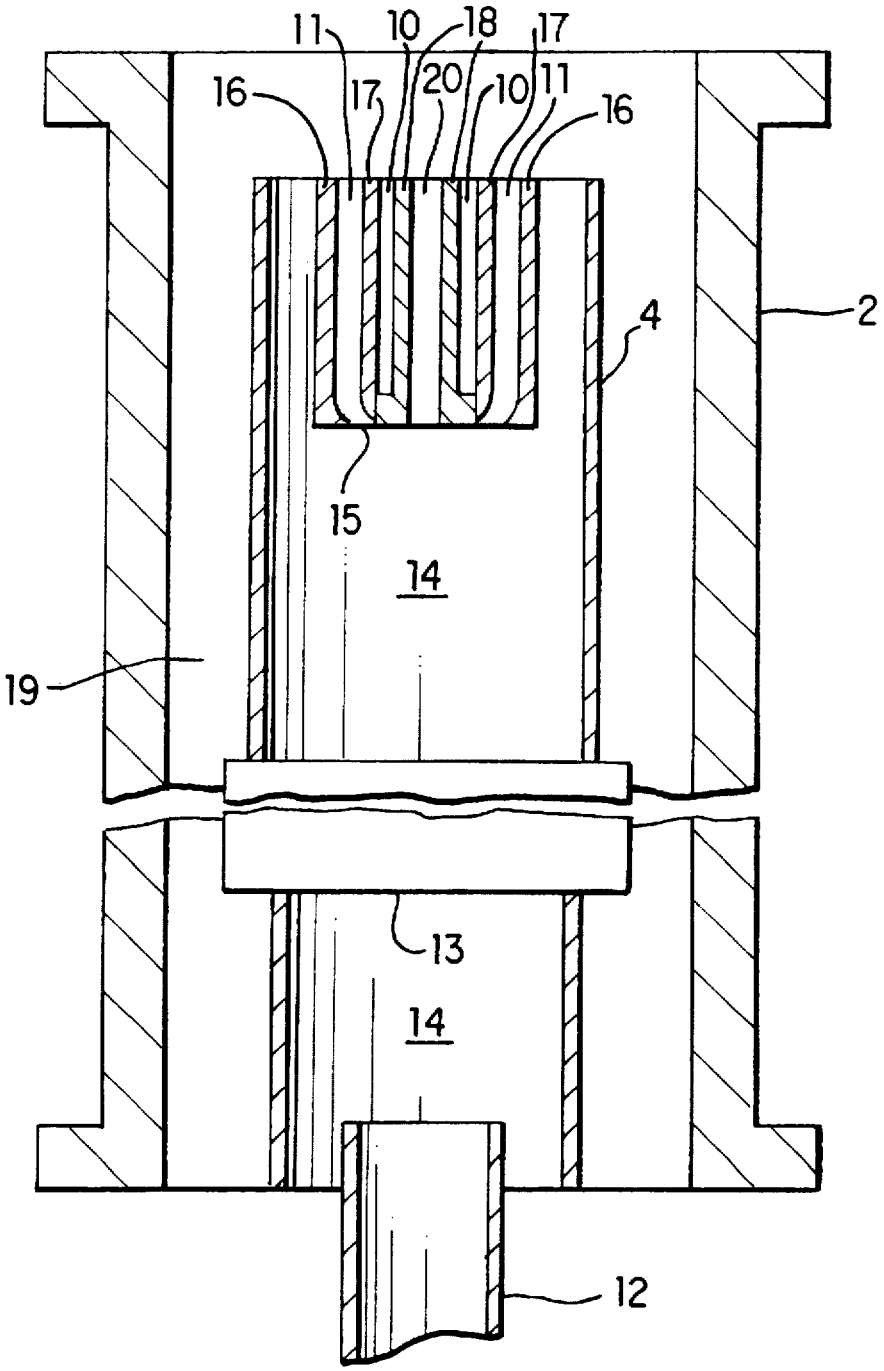
FIG. 2 is a schematic illustration of a flow reactor for producing magnesium in accord with an embodiment of the present invention.

FIG. 2 depicts in schematic form, one type of device 15 to introduce premixed feed 7 into the main reactor chamber 4 for heating in a portion of the region 14. Device 15 is designed and structured to have a feed delivery passageway 20, which is surrounded by walls 17 and 18, which provide a passage 10 through which fluid can be circulated to control the temperature in the passageway 20. The device 15 can have additional walls 16, which together with the walls 17, provide another passageway 11. Passageway 11 will permit fluid, preheated to near or even substantially above the desired reaction temperature, to be introduced via passage way 11 into the upper portion of the region 14 within the main reaction chamber 4 to expedite, or to control to advantage, the heating up of the feed stream 7 entering from passageway 20. The fluid exiting passageway 11 can also be used to minimize or eliminate contacting of the feed stream and/or reaction products with the walls of the main reactor chamber 4. In some embodiments of the invention, one or more of these same purposes can be accomplished by omitting the walls 16 entirely, and allowing the walls 4 of the main reactor chamber itself, to serve essentially the same function as the walls 16. It will be recognized and understood by those skilled in the art that, as used herein, the term "fluid" denotes a gas, a liquid, mixtures of the two, or mixtures of gas and/or liquid which also contain entrained solid matter.

In certain circumstances, besides premixing at low temperature as discussed above, additional measures of feed preparation can be necessary. Thus, once the feed is premixed, it can be subjected to some measure of preheating, e.g., by heat exchange with process effluent streams, or by any other suitable means of heating, for example, to improve the overall thermal efficiency of our process. Further, some of the Mg entering the process as MgO may be converted to magnesium carbides, e.g., according to the global reactions:

$$MgO+3CH_4 \rightarrow MgC_2+CO+6H_2 \quad (6)$$

$$2MgO+5CH_4 \rightarrow Mg_2C_3+2CO+10H_2 \quad (7)$$

The $MgC_2$ and $Mg_2C_3$ can then be recycled to the process, e.g. to vessel 1 via line 40 after opening valve 41, for conversion to Mg, or if desired the $MgC_2$ and/or $Mg_2C_3$, respectively, can be converted to acetylene or methylacetylene/propadiene by reaction with water (e.g., see Peters and Howard, U.S. Pat. Nos. 4,921,685 and 5,246,550). The conditions of the process of the present invention are chosen so that Reactions (6) and (7) do not divert significant quantities of magnesium in the feed stream from production of elemental Mg, i.e., the process is preferably operated to keep net yields of $MgC_2$ and $Mg_2C_3$, exiting the main reactor chamber 4, less than about 15 wt % and preferably less than about 10 wt % of the magnesium fed to the process.

Figure 3:
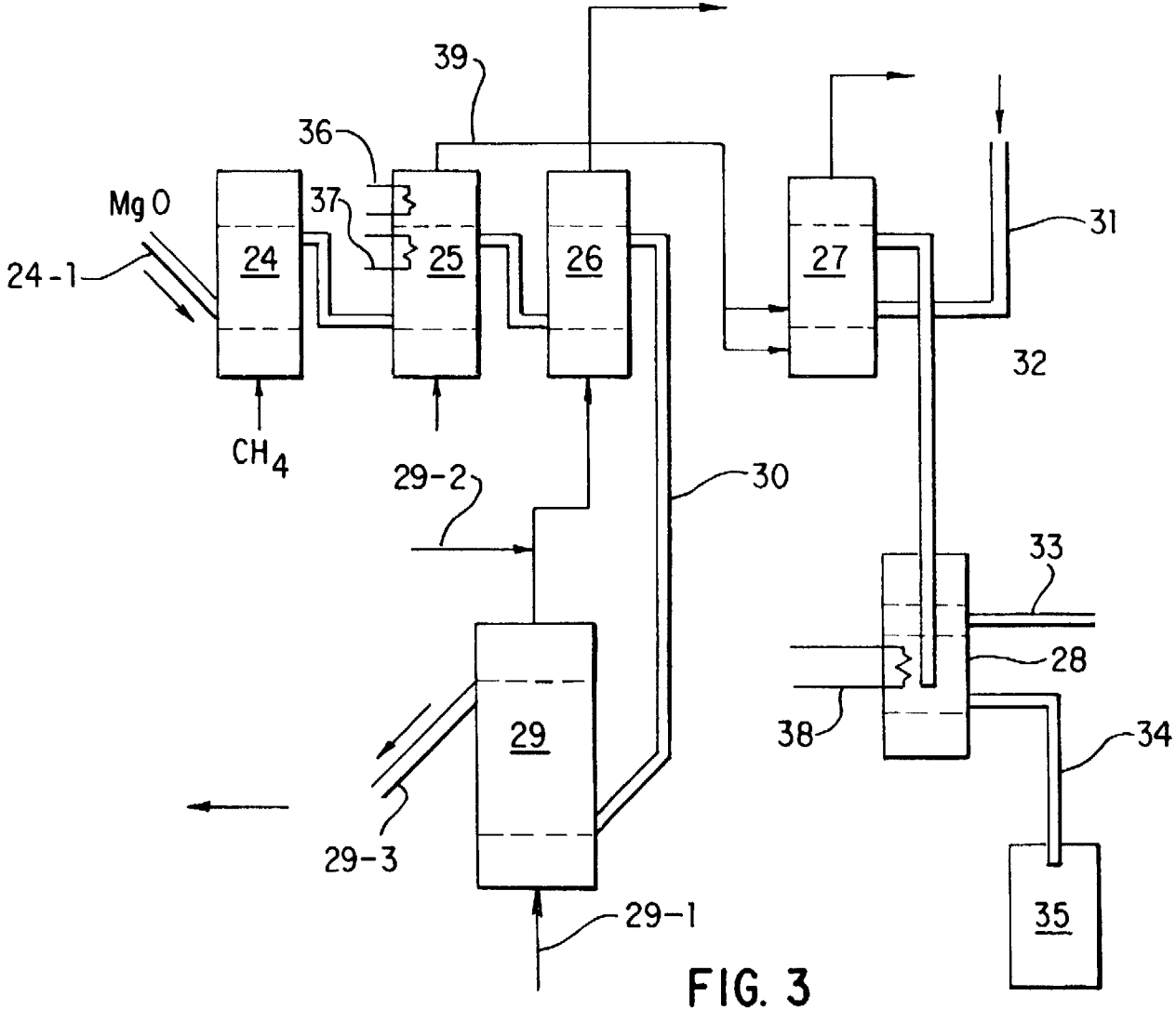
FIG. 3 is another schematic diagram illustrating an embodiment of the process of the present invention.
Figure 4:
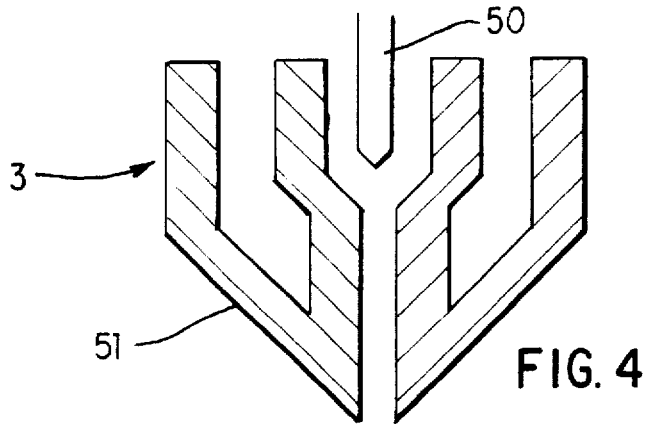
FIG. 4 is a schematic illustration of an electrode structural arrangement for producing an electric arc in one embodiment of the present invention.

Equipment for operating the process can be structured and arranged as a series of interconnected fluidized bed or entrained bed vessels that separately, or in suitable combinations, fulfill the functions described above for the premixing chamber 1, the main reactor chamber 4, and the products separation chamber 9. FIG. 3 illustrates, in schematic form, one configuration or arrangement of such equipment. This arrangement also can account for the case where CaO is included as part of the MgO feed, e.g., as calcined dolomite, and is converted to $CaC_2$, and then to acetylene.

In FIG. 3, vessel 24 is the premixing chamber, vessel 25 is the portion of the main reactor chamber where the feed stream is heated to reaction temperature and reaction occurs, vessel 26 is a transitioning region to collect solids separated from magnesium vapor, and to allow for conversion of metal carbides (e.g., $CaC_2$, $MgC_2Mg_2C_3$), if present in those solids, to acetylenes, by reaction with steam. Unreacted solids like MgO and CaO, and converted solids such as $Mg(OH)_2$, $Ca(OH)_2$, carbonaceous solids etc. are conveyed from vessel 26 via transfer line 30 to a regeneration bed 29, which calcines hydroxides back to MgO and CaO, respectively, using heat supplied externally, or by burning waste carbon and/or methane in this bed (supplied at 29-1). The resulting steam is recycled to vessel 26 for reuse, together with makeup steam (at 29-2), if needed, and the MgO and CaO are recycled at 29-3 for reuse in the process, i.e., to be mixed together with fresh MgO and CaO feed (at 24-1).

In the embodiment illustrated in FIG. 3, Mg is intentionally kept as vapor in vessel 25. Some heat can be extracted from vessel 25, e.g., from the dense phase portion of the bed, or from the freeboard, or from both locations, by means of the heat exchangers 36 and 37. This partially cools the reaction products to avoid loss of elemental magnesium by reaction with CO, e.g., by the reaction of equation (5), and to help with overall process heat integration. Via the line 39, magnesium vapor is conveyed from vessel 25 to vessel 27 with the product gases CO, $H_2$ and unconverted $CH_4$.

In vessel 27, the Mg is separated from these gases, by cooling, condensation as liquid, and/or partitioning onto the quenching/recovery (Q-R) agents introduced to vessel 27 via line 31. Thus, in this embodiment, vessel 27 functions like both the lower portion of region 14 in chamber 4 and like the products separation chamber 9 of the illustration in FIG. 1, and the line 31 functions like the injection plenum 13.

Magnesium product is conveyed from vessel 27 via the line 32 to the vessel 28 which serves to separate additional magnesium, e.g., from the Q-R agents. In the embodiment shown, this is accomplished by maintaining an inventory of liquid magnesium in vessel 28, and immersing the exit end of line 32 well below the upper surface of the liquid magnesium. The temperature, e.g., using the heat exchanger 38, degree of mixing, and chemical environment of the contents of the vessel 28 are adjusted to facilitate recovery of additional magnesium, e.g., by separating it from the Q-R agents. The Q-R agents eventually form a separate layer from the liquid magnesium and are separated by drawing them off into line 33, which then recycles them back to line 31 for reuse in vessel 27, together with makeup Q-R agents as needed. Liquid magnesium is removed from vessel 28 by tapping it off into line 34 at a point near the bottom of the liquid magnesium inventory, and collecting it in the vessel 35. Although details of the processing equipment and arrangement are omitted in FIG. 3, the arrangement and operation of this type of equipment is well known and understood by those skilled in the art. Further, the locations for the vessels can be varied, and some or all can be encased in a larger vessel.

Figure 5:
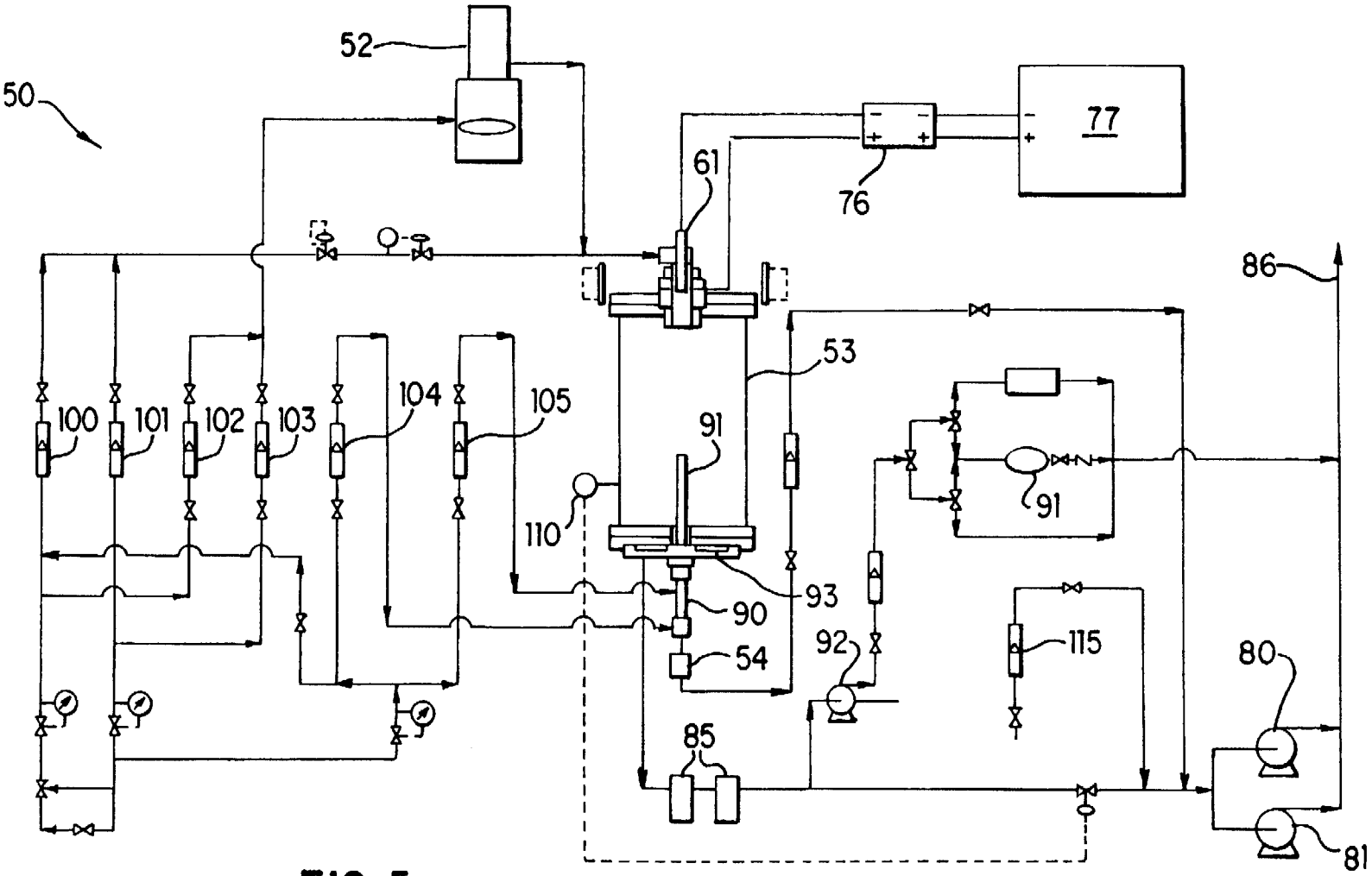
FIG. 5 illustrates schematic diagram of a plasma reactor and associated gas and solids processing equipment including product collection equipment used in a laboratory operation of an embodiment of the process of the present invention.

The process of the present invention was run on experimental apparatus as illustrated in FIG. 5. The experimental apparatus So consists of a plasma reactor 61 containing a plasma generator system, a powder feeder 52, a post reactor cooling chamber 53 for thermally quenching the reactor effluent, and a sample collection system 54, 93, etc. The plasma generator system consists of an arc discharge d.c. plasma torch providing the plasma reactor, a high frequency oscillator 76 (for initiating the arc), a control console and an AIRCO d.c. power supply unit 77 rated by the manufacturer at up to 83 kilowatts ("kW") and capable of providing open circuit output voltages of 80, 160 and 320 volts ("V").

Figure 6:
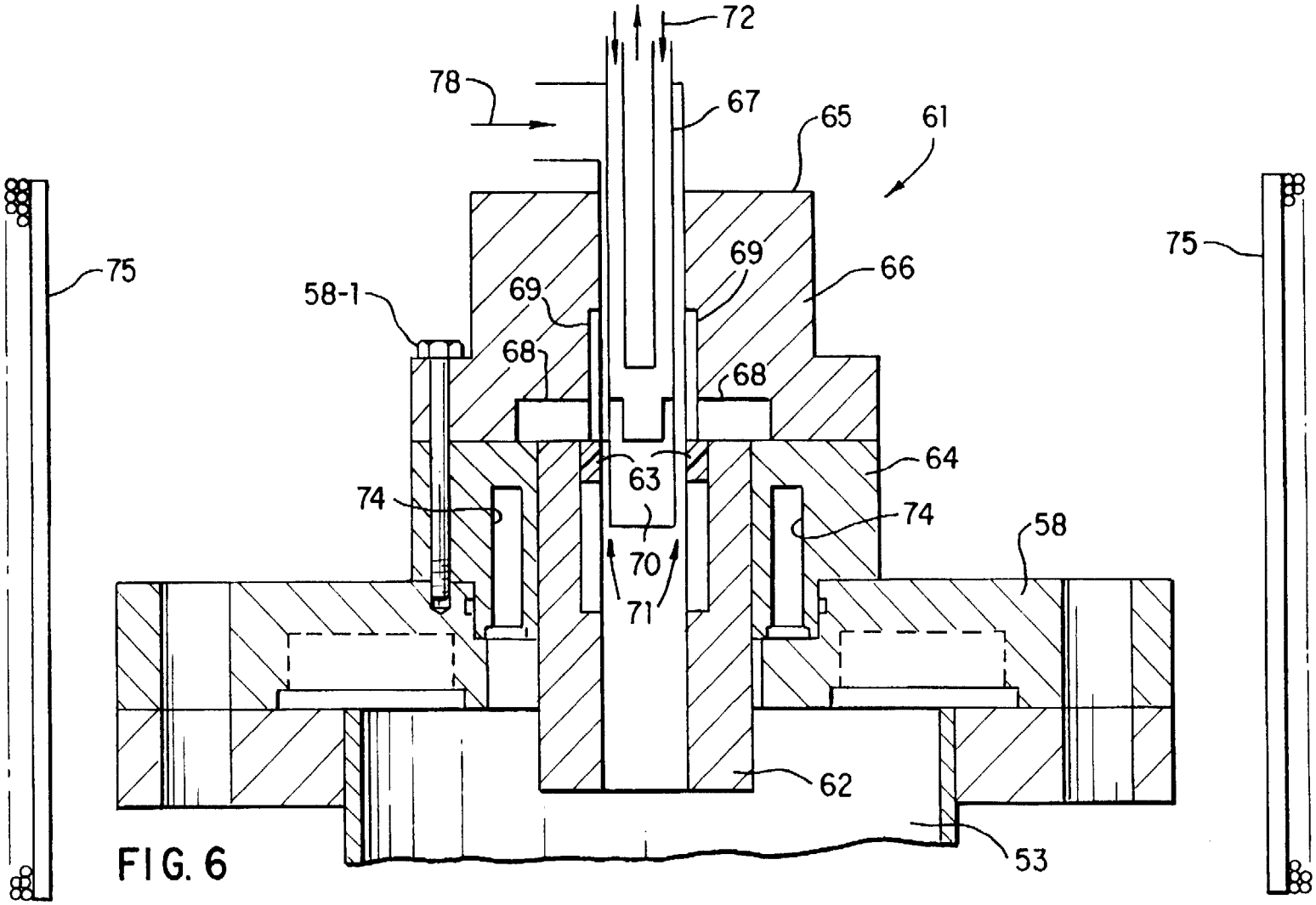
FIG. 6 is a schematic illustration of a plasma reactor useful in connection with the equipment illustrated in FIG. 5 to conduct the process of the present invention.

The plasma reactor 61 is illustrated in further detail in FIG. 6. It was made of a 0.75 inch O.D. graphite cathode and a 1 inch I.D. graphite anode. The anode 62 was held by pipe threads in a water cooled brass anode holder 64, which is mounted on the top flange 58 of the cooling chamber 53. A cooling channel 74 is provided in the anode holder 64. The upper portion of the graphite anode was electrically insulated by a ring 63 made from boron nitride. The cathode assembly 65 included a nylon part 66 that provides a support for the water cooled copper section 67 forming the upper part of the cathode (cooling water was supplied through concentric tubes 72). The nylon part 66 also electrically insulated the cathode from the anode and was secured to the anode holder and to the top flange 58 of the cooling chamber 53 by three screws (one shown at 58-1). A low density alumina ring 68 was used to thermally insulate the nylon support 66 from the anode 62. A high density alumina tube 69 thermally insulated the nylon support from arc radiation. The cathode tip 70 was made of a 1.5 inch long piece of 0.75 inch graphite rod, which was drilled and tapped to be attached to the copper section of the cathode. An annular opening 71 was formed between the anode and cathode, through which gas and other feed materials were fed into the reactor.

In accord with practices well known to those skilled in the art, a solenoid 75 was used to apply a magnetic field perpendicular to the arc current, which induces in the charged particles a velocity component perpendicular to their original direction of travel. Consequently, the path of charged particles moving in a plane perpendicular to the magnetic field will curve. However, the mean free path of the particles remains practically unaltered. Under these conditions, the electrical conductivity of the plasma is more anisotropic resulting in a better confined plasma.

Powder was fed with argon as the carrier gas to the reactor gas inlet 78 using a Miller Thermal, Inc. Model 1270 mechanical wheel-type powder feeder 52. The plasma reactor was mounted on the top of a steel, post reactor cooling chamber 53, which has a water cooled wall for cooling of the reactor effluent and rapid quenching to recover solid and gaseous reaction products. The gaseous products were aspirated from the cooling chamber 53 with two vacuum pumps 80,81 (i) through a sintered disc 93 at the bottom of the chamber and a filter train 85 downstream of the chamber into a ventilation stack 86 and (ii) through the probe 90, as described further below.

Part of the product quenching and collection system consisted of a movable, water cooled and gas quenched collection probe 90 that is mounted at the bottom of the cooling chamber 53. The probe was designed so that the distance of separation between the tip of the plasma "flame" and the entrance 91 to the probe can be adjusted. Solid reaction products were collected for further examination on a sintered stainless steel filter cup 54 located downstream of the probe. In addition, solid reaction products were collected on the sintered disc 93 at the bottom of the cooling chamber 53. Gas samples were collected in a sampling bulb 91 using a sampling pump 92.

Other lines illustrated in FIG. 5 are the main gas line 100 to the plasma reactor, the start gas line 101 to the plasma reactor, the powder carrier gas lines 102,103, the probe radial gas line 104, and the probe quench gas line 105. A pressure controller is shown at 110. Dilution nitrogen gas can be added at 115.

A typical operating procedure was as follows. An argon plasma was first established to operate the plasma reactor. Feeding of the magnesium oxide powder was started about 10 seconds later. MgO powder (at the desired feed rate) was entrained in 9 cubic feet per hour ("cfh") of argon (at ambient temperature) and introduced into the plasma. After a few seconds to establish powder feeding, the argon gas feed to the plasma was switched to methane until a "100% methane" plasma was established, i.e., until the feed gas was nominally 100% methane. The switchover from argon to methane was usually completed gradually within a period of three to five minutes after initiation of the argon plasma. In some experiments, a mixture of argon and methane was used as the feed gas to the plasma.

A number of runs were made using the above apparatus varying conditions such as the flow rate of methane (9.9 to 30 slpm), the flow rate of argon (0 to 15 slpm), the feed rate of MgO (7.6 to 38.2 g/min), the molar ratio of MgO to methane (0.26 to 1.15), the cooling chamber pressure (652 to 777 mm Hg), the arc power input (17.3 to 46 kW), the distance from the nozzle exit of the plasma reactor to the probe inlet (5 to 14 in), and the magnetic field strength 0 to 118 G). The MgO particle size distribution (44–104 μm) was not varied in experimental runs.

Figure 7:
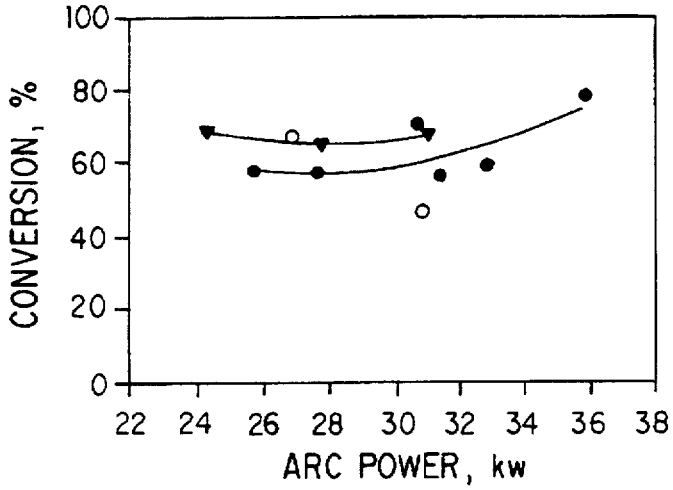
FIG. 7 is a graph illustrating the % conversion of MgO to Mg versus arc power at a flow rate of 20 standard liters per minute (slpm) of methane for various molar feed ratios of MgO:methane.
Figure 8:
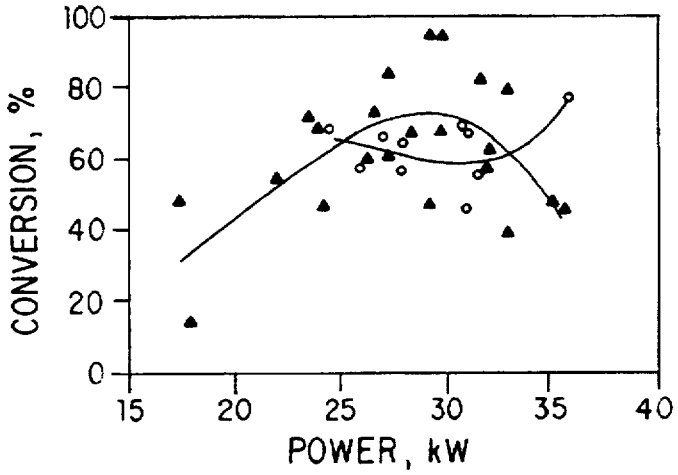
FIG. 8 is a graph illustrating the % conversion of MgO to Mg versus arc power at two different flow rates of methane.
Figure 9:
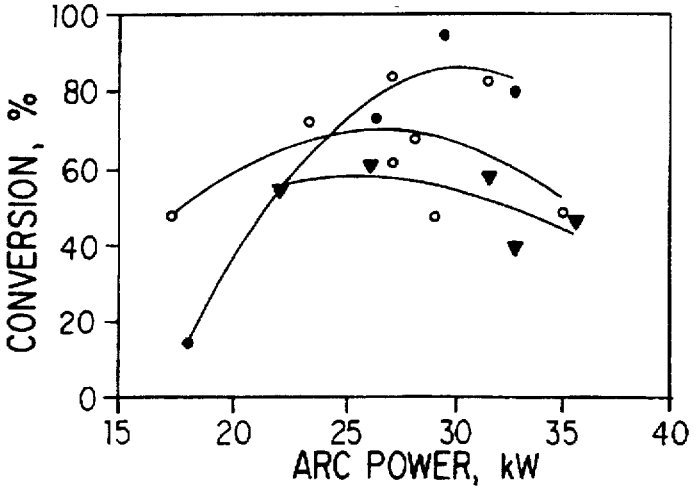
FIG. 9 is a graph illustrating the % conversion of MgO to Mg versus arc power for a 1.15:1 molar feed ratio of MgO to methane at various flow rates of methane and argon.
Figure 10:
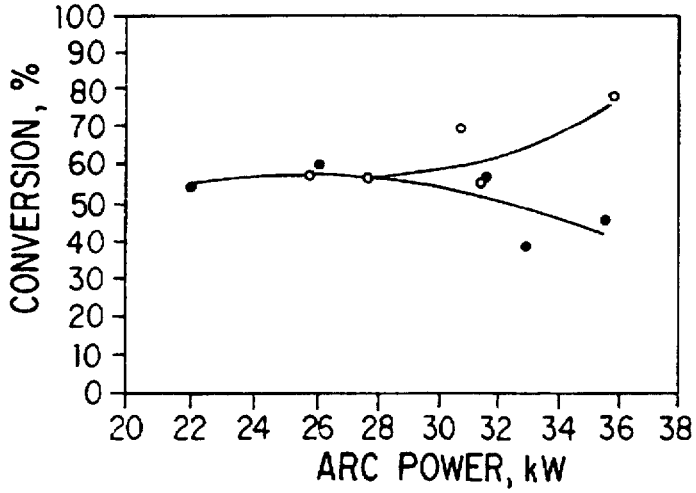
FIG. 10 is a graph illustrating the % conversion of MgO to Mg versus arc power for a 1.15:1 molar feed ratio of MgO to methane at two flow rates of methane.
Figure 11:
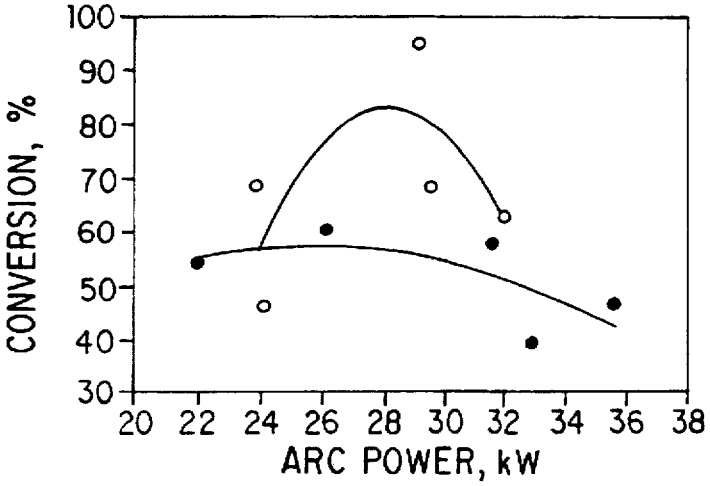
FIG. 11 shows % conversion versus arc power at a flow rate of 10 slpm methane for two molar feed ratios of MgO to methane.

Conversion of MgO to Mg is illustrated in FIGS. 7–11. Data points in these figures represent the results of measurements using apparatus as illustrated in FIGS. 5 and 6. The smooth curves in the figures were added to illustrate trend lines. FIG. 7 shows the % conversion versus arc power at a flow rate of 20 standard liters per minute ("slpm") of methane for various molar ratios of MgO:methane (● is 1.15:1; ○ is 0.8:1; ▼ is 0.46:1). FIG. 8 shows the % conversion versus arc power at different flow rates of methane (▼ is 10 slpm; ○ is 20 slpm). FIG. 9 shows the % conversion versus arc power for a 1.15:1 molar feed ratio of MgO to methane at various flow rates of methane and argon (● is 10 slpm methane+15 slpm argon; ○ is 10 slpm methane+10 slpm argon; ▼ is 10 slpm methane with no argon). FIG. 10 shows % conversion versus arc power for a 1.15:1 molar feed ratio of MgO to methane at two flow rates of methane (● is 10 slpm methane; ○ is 20 slpm methane). FIG. 11 shows % conversion versus arc power at a flow rate of 10 slpm methane for two molar ratios of MgO to methane (● is 1.15:1; ○ is 0.46:1).

Figure 12:
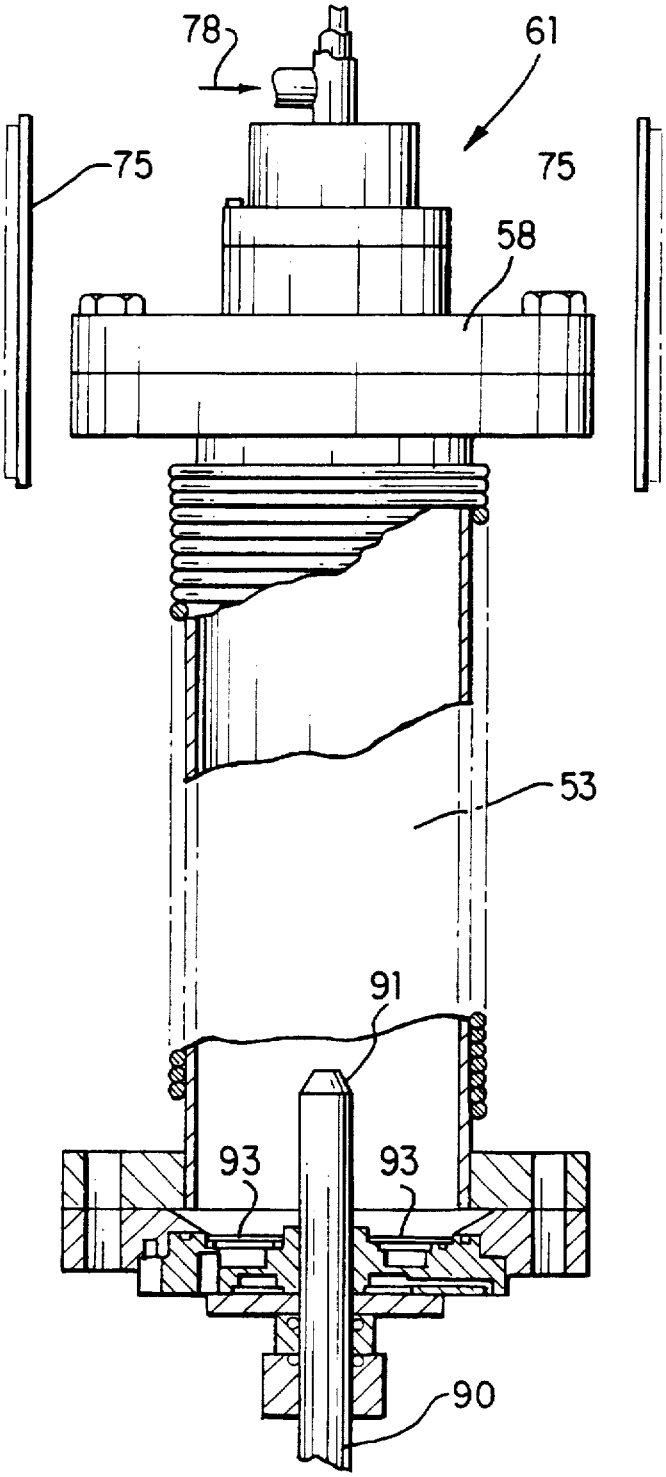
FIG. 12 is a schematic illustration of the plasma reactor, cooling chamber and the relationship of the collection probe and the reactor.

FIG. 12 illustrates the plasma reactor 61 on top of cooling chamber 53. Collection probe 90 is mounted at the bottom of the cooling chamber. The distance between the tip of the plasma flame (not illustrated) and the probe 90 can be adjusted by locating the tip 91 of the probe at the desired position in the cooling chamber.

The invention has been described in detail with reference to preferred embodiments thereof. However, it will be appreciated that, upon consideration of the present specification and drawings, those skilled in the art may make modifications and improvements within the spirit and scope of this invention as defined by the claims.

What is claimed is:

1. A continuous process for the production of elemental magnesium from feed materials comprising magnesium oxide and a light hydrocarbon gas, the process comprising: continuously feeding a feed stream comprising the magnesium oxide and the light hydrocarbon gas directly into a high temperature reaction zone, reacting the magnesium oxide and gas at a temperature of about 1400° C. or greater in the reaction zone to provide a continuous product stream comprising reaction products including elemental magnesium, continuously quenching the product stream, and separating the elemental magnesium from other reaction products.

2. The process of claim 1, wherein the magnesium oxide is pretreated by grinding the magnesium oxide into particles so that about 85 wt % or more of the magnesium oxide is in the form of particles having an average size of about 2 mm, or less.

3. The process of claim 1, wherein about 85 wt % or more of the magnesium oxide is in the form of particles having an average size of about 1 mm, or less.

4. The process of claim 1, further including rapidly heating the magnesium oxide and gas to the temperature of about 1400° C. or greater.

5. The process of claim 4, wherein the heating is accomplished using a plasma arc discharge.

6. The process of claim 1, wherein the quenching step includes rapidly cooling the product stream to a temperature of about 1100° C. or less.

7. The process of claim 1, wherein the quenching step includes rapidly cooling the product stream to a temperature of about 700° C. or less.

8. The process of claim 1, wherein the light hydrocarbon gas comprises methane as a major component.

9. The process of claim 1, wherein the elemental magnesium is separated as a vapor.

10. The process of claim 1, wherein the elemental magnesium is separated as a liquid.

11. The process of claim 1, wherein the elemental magnesium is separated as a solid.

12. The process of claim 1, wherein the elemental magnesium is separated partially as a vapor and partially as a solid.

13. The process of claim 1, wherein the elemental magnesium is separated partially as a vapor and partially as a liquid.

14. The process of claim 1, wherein the elemental magnesium is separated partially as a liquid and partially as a solid.

15. The process of claim 1, wherein the elemental magnesium is separated partially as a vapor, partially as a liquid and partially as a solid.

16. The process of claim 1, wherein about 85 wt % or more of the magnesium oxide is in the form of particles having an average size of about 0.2 mm, or less.

17. The process of claim 1, wherein the source of MgO in the feed materials consists essentially of calcined dolomite.

18. The process of claim 1, wherein the source of MgO in the feed materials consists essentially of MgO and CaO particles.

19. The process of claim 1, wherein the reaction products comprise CO or $H_2$ gases, and the gases are recovered as products.

20. The process of claim 1, wherein the heating is accomplished using a plasma arc discharge.

21. A continuous process for the production of elemental magnesium from feed materials comprising magnesium oxide and a light hydrocarbon gas, the process comprising: continuously feeding a feed stream comprising the magnesium oxide and gas into a reaction zone, reacting the magnesium oxide and gas at a temperature of about 1400° C. or greater in the reaction zone to provide a continuous product stream comprising reaction products including elemental magnesium, continuously quenching the product stream, and separating the elemental magnesium from other reaction products, wherein the source of MgO in the feed materials consists essentially of calcined dolomite and wherein the reaction products comprise calcium carbide, magnesium carbide, or mixtures thereof, and the process further includes the step of generating acetylene, methylacetylene, propadiene, or mixtures thereof by reacting with water the calcium carbide, magnesium carbide, or mixtures thereof.

22. A continuous process for the production of elemental magnesium from feed materials comprising magnesium oxide and a light hydrocarbon gas, the process comprising: continuously feeding a feed stream comprising the magnesium oxide and gas into a reaction zone, reacting the magnesium oxide and gas at a temperature of about 1400° C. or greater in the reaction zone to provide a continuous product stream comprising reaction products including elemental magnesium, continuously quenching the product stream, and separating the elemental magnesium from other reaction products, wherein the source of MgO in the feed materials consists essentially of MgO and CaO particles and wherein the reaction products comprise calcium carbide, magnesium carbide, or mixtures thereof, and the process further includes the step of generating acetylene, methylacetylene, propadiene, or mixtures thereof by reacting with water the calcium carbide, magnesium carbide, or mixtures thereof.

* * * * *